US007365309B2

(12) United States Patent
Denny et al.

(10) Patent No.: US 7,365,309 B2
(45) Date of Patent: Apr. 29, 2008

(54) MASS SPECTROMETER

(75) Inventors: Richard Denny, Staffordshire (GB); Keith Richardson, Derbyshire (GB); John Skilling, Co. Kerry (IE)

(73) Assignee: Micromass UK Limited

( * ) Notice: Subject to any disclaimer, the term of this patent is extended or adjusted under 35 U.S.C. 154(b) by 156 days.

(21) Appl. No.: 11/018,086

(22) Filed: Dec. 21, 2004

(65) Prior Publication Data

US 2005/0230611 A1 Oct. 20, 2005

Related U.S. Application Data

(60) Provisional application No. 60/585,772, filed on Jul. 7, 2004.

(30) Foreign Application Priority Data

Dec. 22, 2003 (GB) ..... 0329544.0

(51) Int. Cl.
*H01J 49/00* (2006.01)

(52) U.S. Cl. ..... 250/282; 250/281

(58) Field of Classification Search ..... 250/282
See application file for complete search history.

(56) References Cited

U.S. PATENT DOCUMENTS

| | | | | |
|---|---|---|---|---|
| 6,008,490 | A * | 12/1999 | Kato | 250/282 |
| 6,822,222 | B2 * | 11/2004 | Hayek et al. | 250/281 |
| 6,906,320 | B2 * | 6/2005 | Sachs et al. | 250/282 |
| 2002/0063208 | A1 | 5/2002 | Hastings | |

FOREIGN PATENT DOCUMENTS

| | | |
|---|---|---|
| WO | WO 01/35266 | 11/2000 |

OTHER PUBLICATIONS

Combined Search and Examination Report under Sections 17 and 18(3), dated Apr. 7, 2005.
Kast et al, Noise Filtering Techniques for Electrospray Quadrupole Time of Flight Mass Spectra, J. Am. Soc. Mass Spectrom. 2003, 14, 766-776.

* cited by examiner

*Primary Examiner*—Jack Berman
*Assistant Examiner*—Phillip A. Johnston
(74) *Attorney, Agent, or Firm*—Jamie H. Rose

(57) ABSTRACT

A mass spectrometer and a method of mass spectrometry are disclosed wherein periodic background noise is effectively filtered out from the mass spectral data. An overall mass window is superimposed upon the mass spectral data. The overall mass window preferably comprises 21 nominal mass windows each preferably having a width of 1.0005 amu. Each nominal mass window preferably comprises 20 channels. An intensity distribution relating to all the first channels of the 21 nominal mass windows is determined. An intensity quantile is determined from the intensity distribution. The intensity quantile is taken to represent the background intensity in the first channel of the central nominal mass window. This process is repeated for the other channels so that the background intensity across the whole of the central nominal mass window is estimated and then subtracted from the raw mass spectral data comprising the central nominal mass window. The overall mass window is then preferably advanced approximately 1 amu and the process is repeated multiple times.

33 Claims, 9 Drawing Sheets

MASS SPECTROMETER

CROSS REFERENCE TO RELATED APPLICATIONS

This application claims priority from UK patent application no. GB 0329544.0 filed 22 Dec. 2003 and U.S. patent application No. 60/585,772 filed 7 Jul. 2004. The contents of these applications are incorporated herein by reference.

FIELD OF THE INVENTION

The present invention relates to a mass spectrometer and a method of mass spectrometry.

BACKGROUND OF THE INVENTION

Background chemical noise in a mass spectrum can be particularly problematic. The background chemical noise observed in mass spectra often has a periodic nature especially at mass to charge ratios less than 1000. As will be understood by those skilled in the art, all elements have near integral masses. Carbon-only graphite has, by definition, an exact integer mass of 12 and all other molecules of the same nominal mass will have an exact mass which is not quite an exact integer value but yet which is only slightly higher or lower than the corresponding mass of carbon-only graphite.

The most mass sufficient ions formed from organic and biological molecules are saturated hydrocarbons and the most mass deficient ions formed from organic and biological molecules are saturated bromocarbons. Saturated hydrocarbons have a mass sufficiency of about 0.1%. Accordingly, a saturated hydrocarbon with a nominal mass of 100 will have an exact mass of about 100.1 and likewise a saturated hydrocarbon with a nominal mass of 200 will have an exact mass of about 200.2. Saturated bromocarbons have a mass deficiency of about 0.1%. Accordingly, a saturated bromocarbon with a nominal mass of 100 will have an exact mass of about 99.9 and likewise a saturated bromocarbon with a nominal mass of 200 will have an exact mass of about 199.8. As a result, at a nominal mass of 200 singly charged ions can be expected to have exact masses which fall within a relatively narrow mass to charge ratio range of 199.8 to 200.2. Similarly, at a nominal mass of 201 singly charged ions can be expected to have exact masses which fall within a similar relatively narrow mass to charge ratio range 200.8 to 201.2. It will therefore be appreciated that no singly charged ions having exact masses in the range 200.2 to 200.8 will be observed. Accordingly, at relatively low mass to charge ratios the chemical background noise in mass spectra (which is predominantly singly charged) typically exhibits a distinct periodicity of approximately 1 atomic mass units (amu).

For singly charged ions having mass to charge ratios of 500 or more, the range of forbidden exact masses theoretically shrinks to zero and hence it might be expected that the chemical background noise would no longer exhibit a periodicity of approximately 1 atomic mass unit. However, in practice, saturated hydrocarbons and saturated bromocarbons are rarely encountered when mass analysing biochemical samples such as proteins and peptides. Accordingly, the chemical background noise in mass spectra relating to biochemicals or biomolecules commonly exhibits a distinct periodicity of approximately 1 atomic mass unit at mass to charge ratios in excess of 500. Indeed, mass spectra commonly exhibit a distinct periodicity of approximately 1 atomic mass unit at mass to charge ratios up to about 2000 and periodic background noise may, in some circumstances, be observed at mass to charge ratios in excess of 2000.

Most non-halogenated organic molecules have a mass sufficiency in the range 0.0% to 0.1%. Therefore, assuming that halogenated compounds are absent, then it will be appreciated that the chemical background noise can still be expected to have a periodicity of approximately 1 atomic mass unit at mass to charge ratios up to 1000. Indeed, in practice, chemical background noise having a periodicity of approximately 1 atomic mass unit is commonly observed when mass analysing ions derived from biomolecules having mass to charge ratios up to about 2000.

Many mass spectrometric techniques have detection limits which are restricted or otherwise compromised by the presence of chemical background noise. The precise chemical nature of the background noise is often unknown and the presence of unwanted chemical background noise can adversely affect mass measurement accuracy especially if an analyte signal is not fully resolved due to chemical background noise.

Chemical background noise may, for example, arise from impurities in solvents, analytes or reagents. Impurities in drying or nebulizing gases can also cause chemical background noise. Contamination of the solvent or analyte delivery system or contamination within or on the surfaces of an ionisation chamber can be a further source of chemical background noise.

In Atmospheric Pressure Ionisation ("API") ion sources such as Electrospray ("ESI"), Photo Ionisation ("APPI") or Atmospheric Chemical Ionisation ("APCI") ion sources, chemical background can arise from the clustering of solvent and analyte ions. In Chemical Ionisation ("CI") ion sources chemical background can arise from self-adduction of reagent gas ions or from reagent gas contamination. In Matrix Assisted Laser Desorption Ionisation ("MALDI") ion sources chemical background can arise from matrix cluster ions.

In general the chemical background noise observed in mass spectra tends to be complex in nature and may only be partially mass resolved. The chemical background noise tends to be singly charged and to have a periodic nature with a repeat unit of approximately 1 atomic mass unit. Amino acids have a mass sufficiency which varies from about 1.00009 to about 1.00074, with a mean mass sufficiency of approximately 1.00047. Accordingly, biological samples commonly exhibit a periodicity of approximately 1.0005 atomic mass units (Daltons).

A known approach to reducing the effects of periodic background chemical noise in a mass spectrum is to transform the mass spectrum into the frequency domain and then to filter out noise components. Signals in the transformed spectrum which are considered to represent noise can then be removed at certain calculated frequencies. An inverse transform is then applied to the transformed spectrum in order to reproduce a mass spectrum which exhibits reduced periodic background noise.

Non-sinusoidal periodic noise will appear as a series of sharp spikes and harmonics in the frequency domain or transformed spectrum. Ion signals however, since they are of relatively small extent in mass to charge ratio, will tend to be smeared out across a relatively broad range of frequencies. The different characteristics of signal and noise in the frequency domain or transformed spectrum can in theory at least be used to allow the contribution of chemical background noise in the overall spectrum to be reduced. However, one problem with frequency domain filtering is that the unprocessed time of flight mass spectra data will comprise intensity data which is equally spaced in time due to the acquisition electronics. Since flight time in a Time of Flight mass analyser is proportional to the square root of the mass to charge ratio of the ions, the intensity data will be unequally spaced with respect to mass to charge ratio. Accordingly, prior to filtering the data in the frequency domain or transformed spectrum, it is first necessary to process the mass spectral data such that the intensity data is more equally spaced with respect to mass to charge ratio. It is known to use an interpolation algorithm to process the intensity data so that the data becomes equally spaced with respect to mass to charge ratio. However, disadvantageously, the use of an interpolation algorithm significantly increases the overall processing time.

In addition to increasing the overall processing time, the known approach of reducing periodic noise in a mass spectrum by filtering the data in the frequency domain suffers from the problem that the application of a filter to the frequency domain data to remove noise components can actually result in additional noise and discontinuities being present into the mass spectrum after data in the frequency domain has been transformed back into the mass to charge ratio domain. As a result, artefacts or spurious peaks can appear in the final processed mass spectrum which were not present in the original mass spectral data.

Another problem with the known frequency domain filtering approach is that a proportion of the desired analyte signal will have frequency components which are similar or identical to the frequency components corresponding to unwanted background noise. Accordingly, the removal of such components in the frequency domain can lead to distortion both of the analyte ion peak shape and also of the intensity of the analyte signal in the final processed mass spectrum.

A yet further problem with the known frequency domain filtering approach is in responding to changes in the characteristic of the background noise as a function of mass to charge ratio. The observed background noise in a mass spectrum often takes on a different nature in different portions of the mass spectrum i.e. the background noise is often observed to vary as a function of mass to charge ratio. If therefore a filter needs to change shape as a function of mass to charge ratio in response to the changing nature of the background noise, then the mass spectrum must first be divided up into a number of separate sections, each of which must then be treated or filtered slightly differently. However, discontinuities can then arise when a composite mass spectrum is subsequently reconstructed from the separate sections of data.

It is apparent therefore that the known frequency domain filtering approach suffers from a number of problems.

It is therefore desired to provide an improved method of reducing the effects of background chemical noise in mass spectra and in particular to reduce the effects of background chemical noise having a periodic nature.

SUMMARY OF THE INVENTION

According to the present invention there is provided a method of mass spectrometry comprising:

determining an intensity distribution from a plurality of different regions or portions of mass spectral data or a mass spectrum;

estimating a background intensity for one or more regions or portions of the mass spectral data or the mass spectrum from the intensity distribution; and adjusting the intensity of one or more regions or portions of the mass spectral data or the mass spectrum in order to remove or reduce the effects of the estimated background intensity.

The plurality of regions or portions of the mass spectral data or the mass spectrum are preferably discrete non-contiguous regions or portions. However, according to less preferred embodiments the plurality of regions or portions of the mass spectral data or the mass spectrum may be substantially contiguous regions or portions.

The plurality of regions or portions of the mass spectral data or the mass spectrum preferably have a periodicity selected from the group consisting of: (i) 0-0.1 amu; (ii) 0.1-0.2 amu; (iii) 0.2-0.3 amu; (iv) 0.3-0.4 amu; (v) 0.4-0.5 amu; (vi) 0.5-0.6 amu; (vii) 0.6-0.7 amu; (viii) 0.7-0.8 amu; (ix) 0.8-0.9 amu; (x) 0.9-1.0 amu; (xi) 1.0-1.1 amu; (xii) 1.1-1.2 amu; (xiii) 1.2-1.3 amu; (xiv) 1.3-1.4 amu; (xv) 1.4-1.5 amu; (xvi) 1.5-1.6 amu; (xvii) 1.6-1.7 amu; (xviii) 1.7-1.8 amu; (xix) 1.8-1.9 amu; (xx) 1.9-2.0 amu; and (xxi)>2.0 amu. According to a preferred embodiment the plurality of regions or portions of the mass spectral data or the mass spectrum may have a periodicity of: (i) 0.4995-0.4996 amu; (ii) 0.4996-0.4997 amu; (iii) 0.4997-0.4998 amu; (iv) 0.4998-0.4999 amu; (v) 0.4999-0.5000 amu; (vi) 0.5000-0.5001 amu; (vii) 0.5001-0.5002 amu; (viii) 0.5002-0.5003 amu; (ix) 0.5003-0.5004 amu; (x) 0.5004-0.5005 amu; (xi) 0.9990-0.9991 amu; (xii) 0.9991-0.9992 amu; (xiii) 0.9992-0.9993 amu; (xiv) 0.9993-0.9994 amu; (xv) 0.9994-0.9995 amu; (xvi) 0.9995-0.9996 amu; (xvii) 0.9996-0.9997 amu; (xviii) 0.9997-0.9998 amu; (xix) 0.9998-0.9999 amu; (xx) 0.9999-1.0000 amu; (xxi) 1.0000-1.0001 amu; (xxii) 1.0001-1.0002 amu; (xxiii) 1.0002-1.0003 amu; (xxiv) 1.0003-1.0004 amu; (xxv) 1.0004-1.0005 amu; (xxvi) 1.0005-1.0006 amu; (xxvii) 1.0006-1.0007 amu; (xxviii) 1.0007-1.0008 amu; (xxix) 1.0008-1.0009 amu; (xxx) 1.0009-1.0010 amu; (xxxi) 0.5 amu; (xxxii) 1.0 amu; and (xxxiii) 1.0005 amu. The unit amu stands for atomic mass units (Daltons). A periodicity in the range 0.9990-1.0010 amu may be observed for singly charged ions and a periodicity in the range of 0.4995-0.5005 amu may be observed for doubly charged ions.

One or more of the plurality of regions or portions of the mass spectral data or the mass spectrum preferably have a width selected from the group consisting of: (i) 0-0.01 amu; (ii) 0.01-0.02 amu; (iii) 0.02-0.03 amu; (iv) 0.03-0.04 amu; (v) 0.04-0.05 amu; (vi) 0.05-0.06 amu; (vii) 0.06-0.07 amu; (viii) 0.07-0.08 amu; (ix) 0.08-0.09 amu; (x) 0.09-0.10 amu; (xi) 0.10-0.11 amu; (xii) 0.11-0.12 amu; (xiii) 0.12-0.13 amu; (xiv) 0.13-0.14 amu; (xv) 0.14-0.15 amu; (xvi) 0.15-0.16 amu; (xvii) 0.16-0.17 amu; (xviii) 0.17-0.18 amu; (xix) 0.18-0.19 amu; (xx) 0.19-0.20 amu; and (xxi)>0.20 amu.

An overall mass window is preferably applied to the mass spectral data or the mass spectrum. The overall mass window preferably comprises m nominal mass windows, wherein m is preferably an integer. According to an embodiment m may be an even number such that, for example, m is selected from the group consisting of: (i) 2; (ii) 4; (iii) 6; (iv) 8; (v) 10; (vi) 12; (vii) 14; (viii) 16; (ix) 18; (x) 20; (xi) 22; (xii) 24; (xiii) 26; (xiv) 28; (xv) 30; (xvi) 32; (xvii) 34; (xviii) 36; (xix) 38; (xx) 40; (xxi) 42; (xxii) 44; (xxiii) 46; (xxiv) 48; (xxv) 50; and (xxvi)>52. According to an alternative and slightly more preferred embodiment, m is preferably an odd number. For example, m may be selected from the group consisting of: (i) 1; (ii) 3; (iii) 5; (iv) 7; (v) 9; (vi) 11; (vii) 13; (viii) 15; (ix) 17; (x) 19; (xi) 21; (xii) 23; (xiii)

25; (xiv) 27; (xv) 29; (xvi) 31; (xvii) 33; (xviii) 35; (xix) 37; (xx) 39; (xxi) 41; (xxii) 43; (xxiii) 45; (xxiv) 47; (xxv) 49; and (xxvi)≧51.

According to a less preferred embodiment m may comprise a fraction.

The nominal mass windows preferably comprise a substantially contiguous region or portion of the whole mass spectral data or the mass spectrum. The nominal mass windows may, less preferably, comprise discrete or non-contiguous regions or portions of the mass spectral data or the mass spectrum. One or more of the nominal mass windows preferably have a width selected from the group consisting of: (i) 0-0.1 amu; (ii) 0.1-0.2 amu; (iii) 0.2-0.3 amu; (iv) 0.3-0.4 amu; (v) 0.4-0.5 amu; (vi) 0.5-0.6 amu; (vii) 0.6-0.7 amu; (viii) 0.7-0.8 amu; (ix) 0.8-0.9 amu; (x) 0.9-1.0 amu; (xi) 1.0-1.1 amu; (xii) 1.1-1.2 amu; (xiii) 1.2-1.3 amu; (xiv) 1.3-1.4 amu; (xv) 1.4-1.5 amu; (xvi) 1.5-1.6 amu; (xvii) 1.6-1.7 amu; (xviii) 1.7-1.8 amu; (xix) 1.8-1.9 amu; (xx) 1.9-2.0 amu; and (xxi)>2 amu.

The nominal mass windows may each have a width selected from the group consisting of: (i) 0.4995-0.4996 amu; (ii) 0.4996-0.4997 amu; (iii) 0.4997-0.4998 amu; (iv) 0.4998-0.4999 amu; (v) 0.4999-0.5000 amu; (vi) 0.5000-0.5001 amu; (vii) 0.5001-0.5002 amu; (viii) 0.5002-0.5003 amu; (ix) 0.5003-0.5004 amu; (x) 0.5004-0.5005 amu; (xi) 0.9990-0.9991 amu; (xii) 0.9991-0.9992 amu; (xiii) 0.9992-0.9993 amu; (xiv) 0.9993-0.9994 amu; (xv) 0.9994-0.9995 amu; (xvi) 0.9995-0.9996 amu; (xvii) 0.9996-0.9997 amu; (xviii) 0.9997-0.9998 amu; (xix) 0.9998-0.9999 amu; (xx) 0.9999-1.0000 amu; (xxi) 1.0000-1.0001 amu; (xxii) 1.0001-1.0002 amu; (xxiii) 1.0002-1.0003 amu; (xxiv) 1.0003-1.0004 amu; (xxv) 1.0004-1.0005 amu; (xxvi) 1.0005-1.0006 amu; (xxvii) 1.0006-1.0007 amu; (xxviii) 1.0007-1.0008 amu; (xxix) 1.0008-1.0009 amu; (xxx) 1.0009-1.0010 amu; (xxxi) 0.5 amu; (xxxii) 1.0 amu; and (xxxiii) 1.0005 amu.

Some or all of the nominal mass windows are preferably each divided into y channels, wherein y is preferably selected from the group consisting of: (i) 1; (ii) 2; (iii) 3; (iv) 4; (v) 5; (vi) 6; (vii) 7; (viii) 8; (ix) 9; (x) 10; (xi) 11; (xii) 12; (xiii) 13; (xiv) 14; (xv) 15; (xvi) 16; (xvii) 17; (xviii) 18; (xix) 19; (xx) 20; (xxi) 21; (xxii) 22; (xxiii) 23; (xxiv) 24; (xxv) 25; (xxvi) 26; (xxvii) 27; (xxviii) 28; (xxix) 29; (xxx) 30; (xxxi) 31; (xxxii) 32; (xxxiii) 33; (xxxiv) 34; (xxxv) 35; (xxxvi) 36; (xxxvii) 37; (xxxviii) 38; (xxxix) 39; (xl) 40; (xli) 41; (xlii) 42; (xliii) 43; (xliv) 44; (xlv) 45; (xlvi) 46; (xlvii) 47; (xlviii) 48; (xlix) 49; (l) 50; and (li)>50.

The step of determining an intensity distribution from a plurality of different regions or portions of mass spectral data or a mass spectrum preferably comprises determining the frequency of the various intensities of the mass spectral data or the mass spectrum in one or more of the nth channels of one or more of the nominal mass windows. Preferably, n ranges from 1 to y.

The step of estimating a background intensity for one or more regions or portions of the mass spectral data set or mass spectrum from the intensity distribution preferably comprises determining an x % intensity quantile from the intensity distribution.

Preferably, x is selected from the group consisting of: (i) 0-5; (ii) 5-10; (iii) 10-15; (iv) 15-20; (v) 20-25; (vi) 25-30; (vii) 30-35; (viii) 35-40; (ix) 40-45; (x) 45-50; (xi) 50-55; (xii) 55-60; (xiii) 60-65; (xiv) 65-70; (xv) 70-75; (xvi) 75-80; (xvii) 80-85; (xix) 85-90; (xx) 90-95; and (xxi) 95-100.

The estimated background intensity preferably comprises the x % intensity quantile or a factor thereof.

The step of adjusting the intensity of one or more regions or portions of the mass spectral data set or mass spectrum in order to remove or reduce the effects of the estimated background intensity preferably comprises subtracting the estimated background intensity or a fraction thereof from the one or more regions or portions of the mass spectral data or mass spectrum. If the intensity of one or more regions or portions of the mass spectral data set or mass spectrum has a negative value or values after substraction of the estimated background intensity or a fraction thereof, then the intensity of the one or more regions or portions of the mass spectral data set or mass spectrum is adjusted or set to zero or near zero.

The estimated background intensity or a fraction thereof is preferably subtracted from z % of the mass spectral data set or the mass spectrum, wherein z is preferably selected from the group consisting of: (i) 0-10; (ii) 10-20; (iii) 20-30; (iv) 30-40; (v) 40-50; (vi) 50-60; (vii) 60-70; (viii) 70-80; (ix) 80-90; and (x) 90-100. The estimated background intensity or a fraction thereof is preferably subtracted from the one or more regions or portions of the mass spectral data or the mass spectrum.

The overall mass window is preferably advanced (or less preferably withdrawn or retreated) one or more times. For example, the overall mass window may be advanced or withdrawn at least 1-10, 10-50, 50-100, 100-150, 150-200, 200-250, 250-300, 300-350, 350-400, 400-450, 450-500, 500-600, 600-700, 700-800, 800-900, 900-1000, 100-1250, 1250-1500, 1500-1750, 1750-2000, 2000-2250, 2250-2500, 2500-2750, 2750-3000 or in excess of 3000 times. According to the preferred embodiment the overall mass window may be advanced or retreated in steps of 0.5, 1.0 or 1.0005 atomic mass units (Daltons) or some other amount each time. It is contemplated the overall mass window could be advanced or retreated with an increment selected from the group consisting of: (i) 0.4995-0.4996 amu; (ii) 0.4996-0.4997 amu; (iii) 0.4997-0.4998 amu; (iv) 0.4998-0.4999 amu; (v) 0.4999-0.5000 amu; (vi) 0.5000-0.5001 amu; (vii) 0.5001-0.5002 amu; (viii) 0.5002-0.5003 amu; (ix) 0.5003-0.5004 amu; (x) 0.5004-0.5005 amu; (xi) 0.9990-0.9991 amu; (xii) 0.9991-0.9992 amu; (xiii) 0.9992-0.9993 amu; (xiv) 0.9993-0.9994 amu; (xv) 0.9994-0.9995 amu; (xvi) 0.9995-0.9996 amu; (xvii) 0.9996-0.9997 amu; (xviii) 0.9997-0.9998 amu; (xix) 0.9998-0.9999 amu; (xx) 0.9999-1.0000 amu; (xxi) 1.0000-1.0001 amu; (xxii) 1.0001-1.0002 amu; (xxiii) 1.0002-1.0003 amu; (xxiv) 1.0003-1.0004 amu; (xxv) 1.0004-1.0005 amu; (xxvi) 1.0005-1.0006 amu; (xxvii) 1.0006-1.0007 amu; (xxviii) 1.0007-1.0008 amu; (xxix) 1.0008-1.0009 amu; (xxx) 1.0009-1.0010 amu; (xxxi) 0.5 amu; (xxxii) 1.0 amu; and (xxxiii) 1.0005 amu. According to another embodiment it is contemplated that the overall mass window could be advanced, withdrawn or translated (preferably repeatedly) with an increment preferably selected from the group consisting of: (i) 0-0.1 amu; (ii) 0.1-0.2 amu; (iii) 0.2-0.3 amu; (iv) 0.3-0.4 amu; (v) 0.4-0.5 amu; (vi) 0.5-0.6 amu; (vii) 0.6-0.7 amu; (viii) 0.7-0.8 amu; (ix) 0.8-0.9 amu; (x) 0.9-1.0 amu; (xi) 1.0-1.1 amu; (xii) 1.1-1.2 amu; (xiii) 1.2-1.3 amu; (xiv) 1.3-1.4 amu; (xv) 1.4-1.5 amu; (xvi) 1.5-1.6 amu; (xvii) 1.6-1.7 amu; (xviii) 1.7-1.8 amu; (xix) 1.8-1.9 amu; (xx) 1.9-2.0 amu; and (xxi)>2 amu. According to other embodiments the overall mass window may be advanced or withdrawn in regular, non-regular or random steps or increments.

According to another aspect of the present invention there is provided a mass spectrometer comprising:

means which determines, in use, an intensity distribution from a plurality of regions or portions of a mass spectral data set or mass spectrum;

means which estimates, in use, a background intensity for one or more regions or portions of the mass spectral data set or mass spectrum from the intensity distribution; and means which adjusts, in use, the intensity of one or more regions or portions of the mass spectral data set or mass spectrum in order to remove or reduce the effects of the estimated background intensity.

The mass spectrometer preferably further comprises an ion source selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) a Laser Desorption Ionisation ("LDI") ion source; (v) an Inductively Coupled Plasma ("ICP") ion source; (vi) an Electron Impact ("EI") ion source; (vii) a Chemical Ionisation ("CI") ion source; (viii) a Field Ionisation ("FI") ion source; (ix) a Fast Atom Bombardment ("FAB") ion source; (x) a Liquid Secondary Ion Mass Spectrometry ("LSIMS") ion source; (xi) an Atmospheric Pressure Ionisation ("API") ion source; (xii) a Field Desorption ("FD") ion source; (xiii) a Matrix Assisted Laser Desorption Ionisation ("MALDI") ion source; (xiv) a Desorption/Ionisation on Silicon ("DIOS") ion source; and (xv) a Desorption Electrospray Ionisation ("DESI") ion source.

The ion source may comprise either a continuous ion source or a pulsed ion source.

The mass spectrometer preferably further comprises a mass analyser arranged preferably selected from the group consisting of: (i) an orthogonal acceleration Time of Flight mass analyser; (ii) an axial acceleration Time of Flight mass analyser; (iii) a quadrupole mass analyser; (iv) a Penning mass analyser; (v) a Fourier Transform Ion Cyclotron Resonance ("FTICR") mass analyser; (vi) a 2D or linear quadrupole ion trap; (vii) a Paul or 3D quadrupole ion trap; and (viii) a magnetic sector mass analyser.

The preferred embodiment relates to an adaptive background subtraction method which reduces the effects of periodic chemical background noise in mass spectra.

The preferred method examines the intensity distribution in a local area of a mass spectrum and estimates that part of the signal due to background noise by statistical analysis. Further areas of the mass spectrum are then preferably analysed and the process is preferably repeated. According to the preferred embodiment, the estimated background noise in a particular portion or region of a mass spectrum is subtracted from the raw or experimentally obtained mass spectral data to produce a processed mass spectrum which exhibits significantly reduced background noise. The preferred embodiment is particularly effective in suppressing background noise having a periodic nature and also background noise which varies with mass to charge ratio.

According to the preferred embodiment the intensity of mass spectral data within a channel of a central nominal mass window is modified by subtracting an intensity value from the mass spectral data within the particular channel. The intensity value which is subtracted is preferably an intensity quantile (e.g. 45% or 50%) of the recorded intensities of mass spectral data within corresponding channels of a plurality of adjacent or neighbouring nominal mass windows. The preferred intensity quantile is preferably 45% or 50%, but according to other embodiments the intensity quantile may be in the range 10-90%.

The preferred method is particularly suitable for reducing the effect of background signals which have periodic intensity variations. The preferred embodiment is also effective in reducing the effect of unwanted background noise when the background noise exhibits a slow continuous variation in intensity relative to the intensity variation associated with an analyte signal. The preferred method also enables automated background subtraction to be performed and enables mass spectra to be produced which have a significantly improved signal to noise ratio.

According to an embodiment of the present invention, a mass spectrum may be divided up into multiple nominal mass windows preferably centered on multiples of, for example, 1.0005 atomic mass units (Daltons). An overall mass window size is preferably chosen which preferably comprises an odd integer number of nominal mass windows. The overall mass window size is preferably relatively large compared to a typical isotope cluster and yet is also preferably relatively small compared to the low frequency noise wavelength. According to a particularly preferred embodiment an overall mass window comprising 21 nominal mass windows may be used wherein the overall mass window has a width of 21.0105 Da. Each nominal mass window is preferably 1.0005 Da wide.

Background noise is preferably estimated and then subtracted from the mass spectral data in one nominal mass window. Each nominal mass window is preferably divided into y discrete channels. The width of each discrete channel y is preferably relatively small compared to the width of noise peaks and yet is also preferably relatively large compared to the spacing of mass spectral data. According to the preferred embodiment each nominal mass window may be divided up into 10-20 channels.

The data in the various nominal mass windows which form the overall mass window can be considered as being collapsed into y discrete channels per nominal mass window. An intensity quantile Q of the data across all the same corresponding channels (i.e. across all the first, second or nth channels of the nominal mass windows) is preferably determined at a fraction x %. The intensity value Q is preferably such that x % of the data in the respective nth channels of the various nominal mass windows lies below the intensity value Q. The intensity quantile is preferably chosen so as to reject predominantly signal whilst accepting predominantly noise. The intensity quantile Q is therefore taken to be a representation of the noise in the corresponding channel of the central nominal mass window. This background noise is then preferably subtracted from the input or raw mass spectral data relating to the corresponding channel of the central nominal mass window. This process is then repeated for the other channels of the central nominal mass window. The overall mass window is then preferably advanced e.g. approximately 1 atomic mass unit, and the process is preferably repeated, preferably multiple times.

The calculated background distribution may, for example, contain data distributed across 20 channels per mass unit whereas the raw mass spectral data may contain many more data points per mass unit. In the case of time of flight data the number of data points per mass unit will vary. The intensity of the estimated background noise which is to be subtracted at a given data point in the original mass spectral data may be calculated by interpolation between the 20 data points which form the estimated background distribution across a nominal mass window having a width of approximately 1 atomic mass unit.

The preferred method has the particular advantage over the known frequency domain filtering method in that the preferred method avoids creating artefacts or extra noise spikes in the processed mass spectral data. Such artefacts or extra noise spikes can be a particular problem when the known frequency domain filtering approach is used.

BRIEF DESCRIPTION OF THE DRAWINGS

Various embodiments of the present invention will now be described, by way of example only, and with reference to the accompanying drawings in which.

DETAILED DESCRIPTION OF THE INVENTION

Figure 1A:
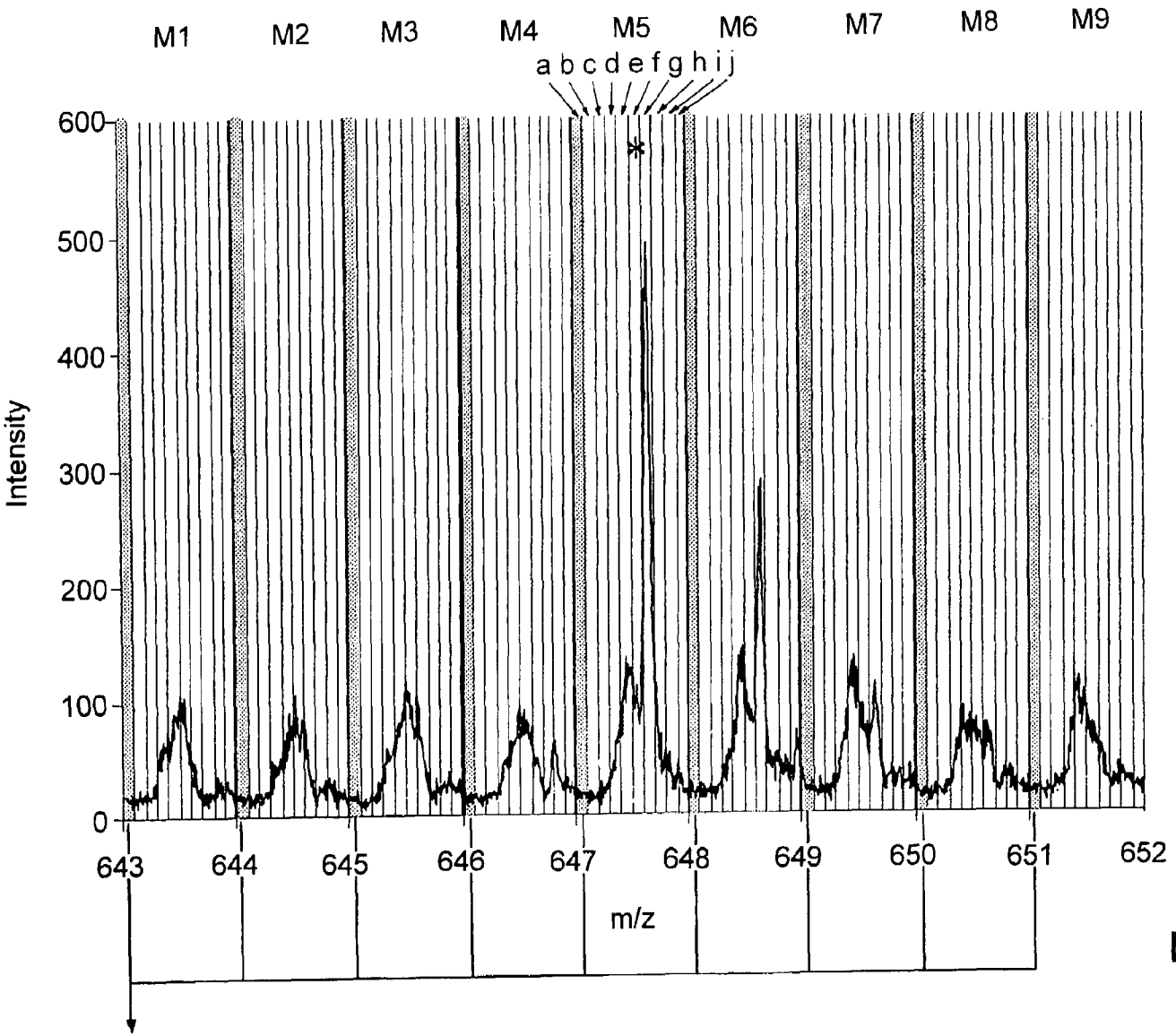
FIG. 1A shows a portion of a mass spectrum exhibiting repetitive chemical noise with an overall mass window comprising nine nominal mass windows each divided into ten channels superimposed upon the portion of the mass spectrum.

An embodiment of the present invention will now be described with reference to FIGS. 1A, 1B and 2. However, the embodiment shown and described with reference to FIGS. 1A, 1B and 2 has been simplified for ease of illustration. According to a particularly preferred embodiment, an overall mass window having a width of 21.0105 atomic mass units (Daltons) and comprising 21 nominal mass windows each 1.0005 atomic mass units (Daltons) wide is applied to a mass spectrum. Each nominal mass window is preferably divided into 20 discrete channels. However, for ease of illustration, the embodiment shown and described with reference to FIGS. 1A, 1B and 2 relates to using a smaller overall mass window which is only 9 atomic mass units wide and which comprises only 9 nominal mass windows each having a width of precisely 1 atomic mass unit (Dalton). Each nominal mass window is shown divided into 10 discrete channels, again for ease of illustration.

FIG. 1A shows a portion of a mass spectrum across the mass to charge ratio range 643-652 which exhibits repetitive or periodic chemical background noise. The mass spectrum was obtained using an Electrospray ion source and a Time of Flight mass analyser. An overall mass window having a width of 9 atomic mass units is shown superimposed upon the portion of the mass spectrum. The overall mass window comprises nine nominal mass windows M1-M9. The nominal mass windows M1-M9 are centred around a central nominal mass window M5 which corresponds to the mass to charge ratio range 647-648. Each of the nine nominal mass windows M1-M9 is shown sub-divided into ten equal width discrete channels a-j. In the particular example shown in FIG. 1A, each discrete channel covers or includes approximately 15 mass intensity pairs or data points. The number of mass intensity pairs or data points per channel depends upon the digitisation rate of the acquisition electronics and the time of flight of the ions analysed.

According to the preferred embodiment, a background signal is estimated and is then subtracted from the raw intensity data corresponding to the first channel M5*a* of the central nominal mass window M5. The estimated background signal for the first channel M5*a* of the central nominal mass window M5 is calculated by first determining the intensity distribution of the intensity data in or across all the first channels M1*a*-M9*a* of all nine nominal mass windows M1-M9 which form the overall mass window. The first channels M1*a*-M9*a* of each of the nine nominal mass windows M1-M9 are shown as shaded areas in FIG. 1A.

Figure 1B:
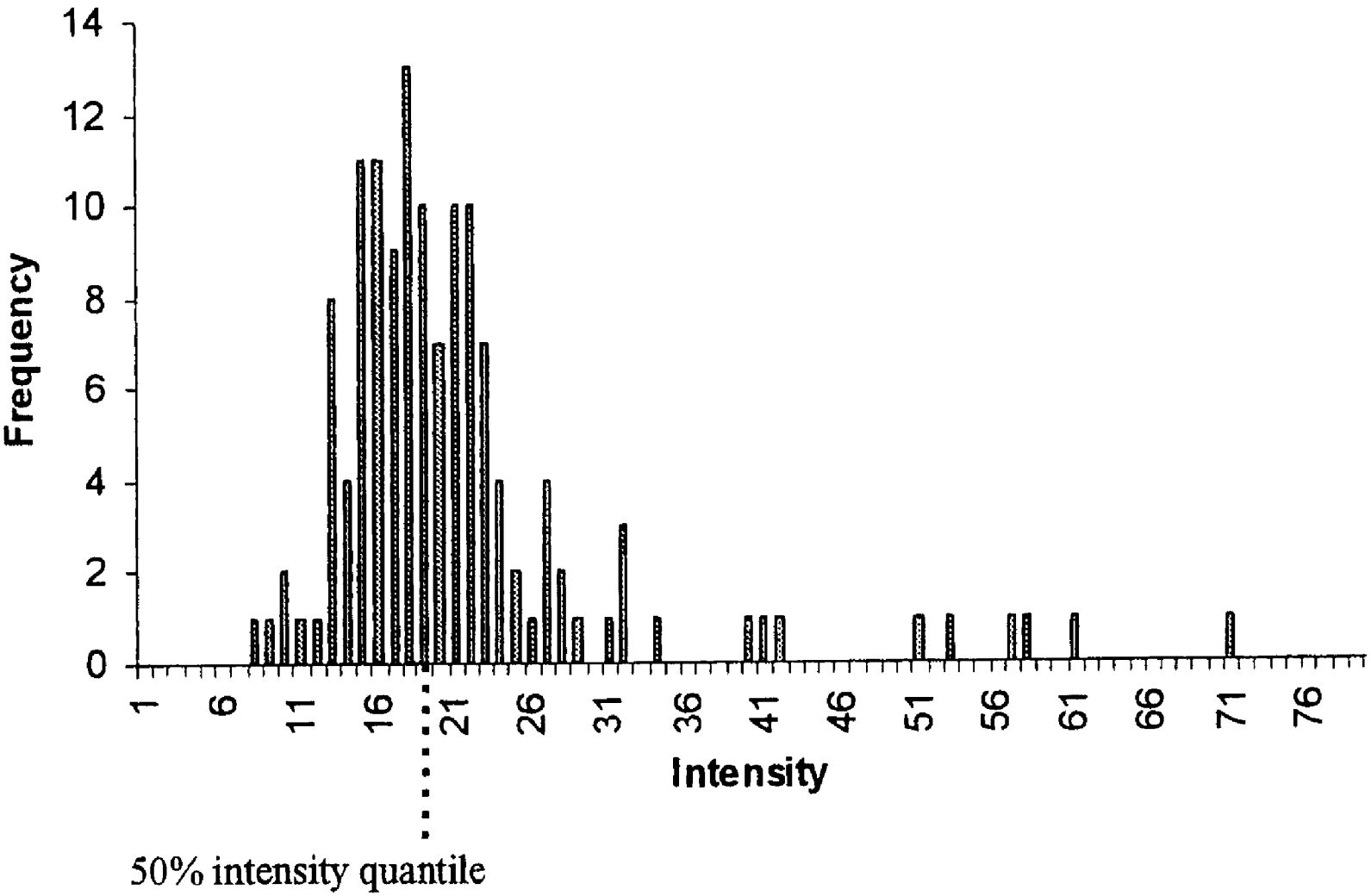
FIG. 1B shows the intensity distribution of all the intensity data taken from all the first channels of the nine nominal mass windows shown in FIG. 1A.

FIG. 1B shows the resulting intensity distribution which corresponds with or represents the intensity data taken from all of the first channels M1*a*-M9*a* of the nine nominal mass windows M1-M9 shown in FIG. 1A. In total, the first channels M1*a*-M9*a* comprise, cover or include approximately 134 data points or distinct intensity measurements. A dotted line indicates the 50% intensity quantile for the intensity distribution shown. In the particular example shown in FIG. 1B, the 50% intensity quantile is 19. A 50% intensity quantile represents an intensity value wherein 50% of the recorded intensities lie below the 50% quantile and 50% of the recorded intensities lie above the 50% quantile. Accordingly, 50% of the intensity data in all the first channels M1*a*-M9*a* of the nine nominal mass windows M1-M9 shown in FIG. 1A has an intensity value$\leqq$19 units and 50% of the intensity data in all the first channels M1*a*-M9*a* of the nine nominal mass windows M1-M9 has an intensity value$\geqq$19 units. Other embodiments are contemplated wherein intensity quantiles other than 50% are used. For example, an intensity quantile of 45% may be used wherein 45% of the intensity data has an intensity less than or equal to the 45% intensity quantile. In the particular example shown in FIG. 1B the 45% intensity quantile would have a value of 18.

In the particular example shown and described with reference to FIGS. 1A, 1B and 2, the 50% intensity quantile value of 19 is deemed as being representative of the average intensity of the background signal in the first channel M5*a* of the central nominal mass window M5. The 50% intensity quantile value of 19 is therefore preferably subtracted from the intensity values of all the raw intensity data which make up or fall within the first channel M5*a* of the central nominal mass window M5.

According to an embodiment if the intensity or the intensity values are negative or take a negative value after subtraction of the intensity quantile value, then preferably the intensity or intensity values are set or adjusted to zero, or less preferably to a value close to zero.

Having determined the predicted intensity of the background signal for the first channel M5*a* of the central nominal mass window M5, this procedure is then preferably repeated for the second channel M5*b* of the central nominal mass window M5. In a similar manner, the 50% intensity quantile for the intensity distribution relating to all the intensity data taken from all the second channels M1*b*-M9*b* of the nine nominal mass windows M1-M9 is preferably determined. This intensity value is then preferably deemed as being representative of the average intensity of the background signal in the second channel M5*b* of the central nominal mass window M5. This new 50% intensity quantile value is then preferably subtracted from the intensity values of all the raw intensity data which make up or fall within the second channel M5*b* of the central nominal mass window M5.

This process is then again preferably repeated in a similar manner for the third, fourth, fifth, sixth, seventh, eighth and ninth channels M5*c*-M5*j* of the central nominal mass window M5. As a result, the background noise is preferably estimated across the whole of the width of the central nominal mass window M5 and the estimated background noise is then preferably duly subtracted from the raw intensity data in all ten channels M5*a-j* of the central nominal mass window M5. According to an embodiment, if the intensity data after subtraction of the estimated background noise takes or has a negative value then preferably the intensity data is adjusted or set to zero, or less preferably near zero.

After having calculated and then preferably removed the estimated background noise from the raw intensity data relating to the central nominal mass window M5 which relates to ions having mass to charge ratios in the range 647-648, the overall mass window is then preferably advanced approximately one mass unit further on (or less preferably retracted approximately one mass unit backwards) so that the overall mass window is now preferably centred on the mass to charge ratio range of 648-649. The procedure as described above in relation to determining the background noise across the previous central nominal mass window and mass to charge ratio range 647-648 is then preferably repeated in order now to estimate the background noise across the new central nominal mass window and mass to charge ratio range 648-649. The estimated background noise is then preferably removed from the raw intensity data corresponding to the new central nominal mass window which covers the mass to charge ratio range 648-649. The overall mass window is then preferably advanced approximately one mass unit further on (or less preferably retracted approximately one mass unit backwards) and the process of estimating the background noise and subtracting the estimated background noise from the new central nominal mass window is then preferably repeated.

The process of determining the background noise and subtracting the background noise from the central nominal mass window and then advancing, withdrawing, translating or otherwise moving the overall mass window is then preferably repeated until background noise has been removed from the region, portion or whole of the mass spectrum of interest. According to an embodiment the overall mass window may be advanced, withdrawn or translated at least 10, 50, 100, 200, 300, 400, 500, 600, 700, 800, 900, 1000, 1500, 2000, 2500, 3000, 3500, 4000, 4500 or 5000 times. The width of the overall mass window preferably stays the same, but according to other embodiments the width of the overall mass window may increase, decrease or otherwise vary in a stepped, linear, random or other manner.

Figure 2:
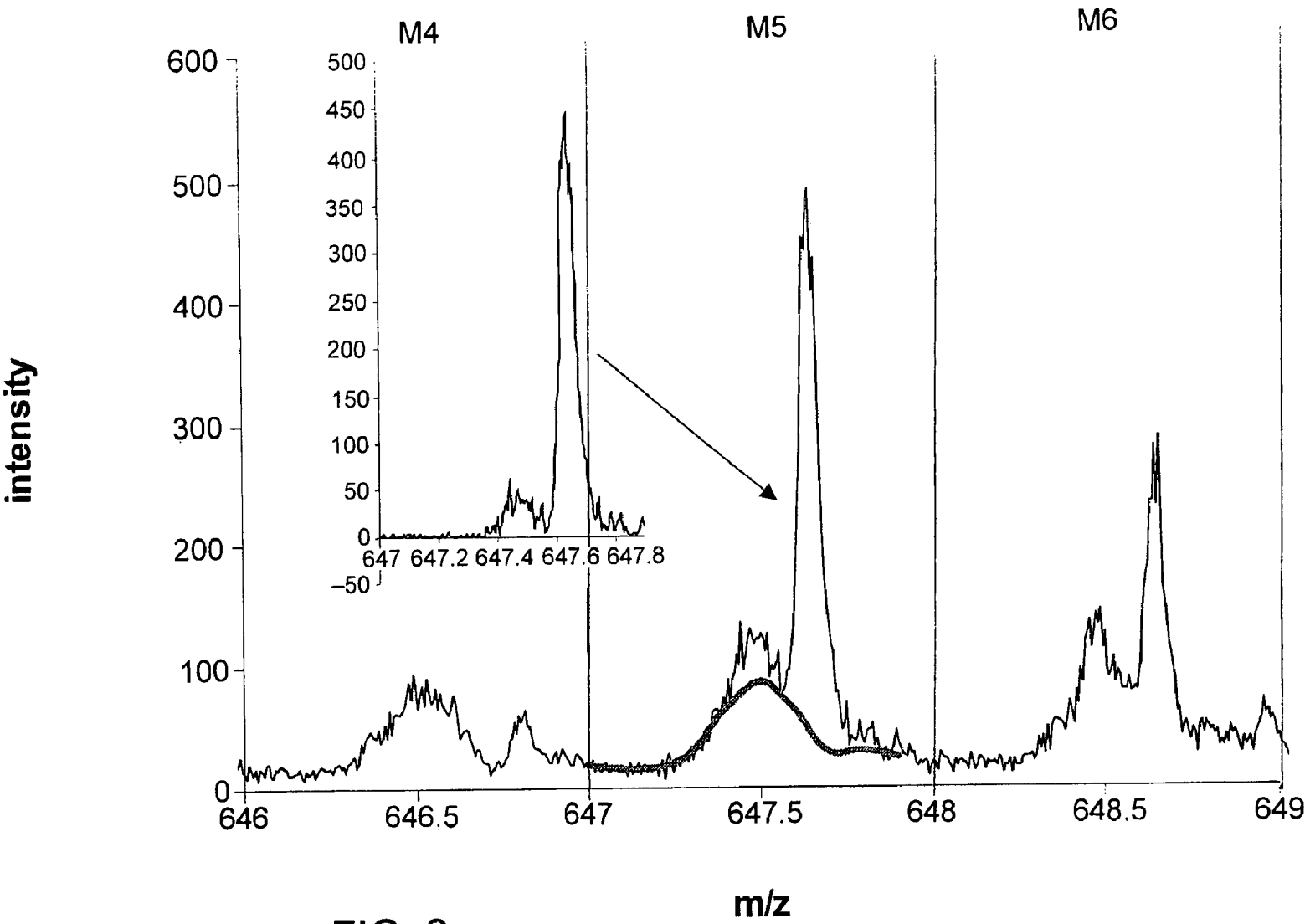
FIG. 2 shows in greater detail the central nominal mass window M5 and the immediately adjacent nominal mass windows M4,M6 as shown in FIG. 1A together with the calculated background noise for most of the central nominal mass window M5, and the inset shows in greater detail the analyte mass peak having a mass to charge ratio of approximately 647.6 after removal of background noise according to the preferred embodiment.

FIG. 2 shows the central nominal mass window M5 and the immediately neighbouring nominal mass windows M4,M6 as shown in FIG. 1A in greater detail. The calculated background noise for most of the central nominal mass window M5 is shown superimposed upon the original or raw intensity or mass spectral data. The inset shows in greater detail a portion of the central nominal mass window M5 after the intensity data has been processed to subtract the calculated or estimated background noise therefrom. An analyte mass peak having a mass to charge ratio of approximately 647.6 can be seen more clearly and the signal to noise ratio of the processed mass spectrum has been significantly improved.

Figure 3A:
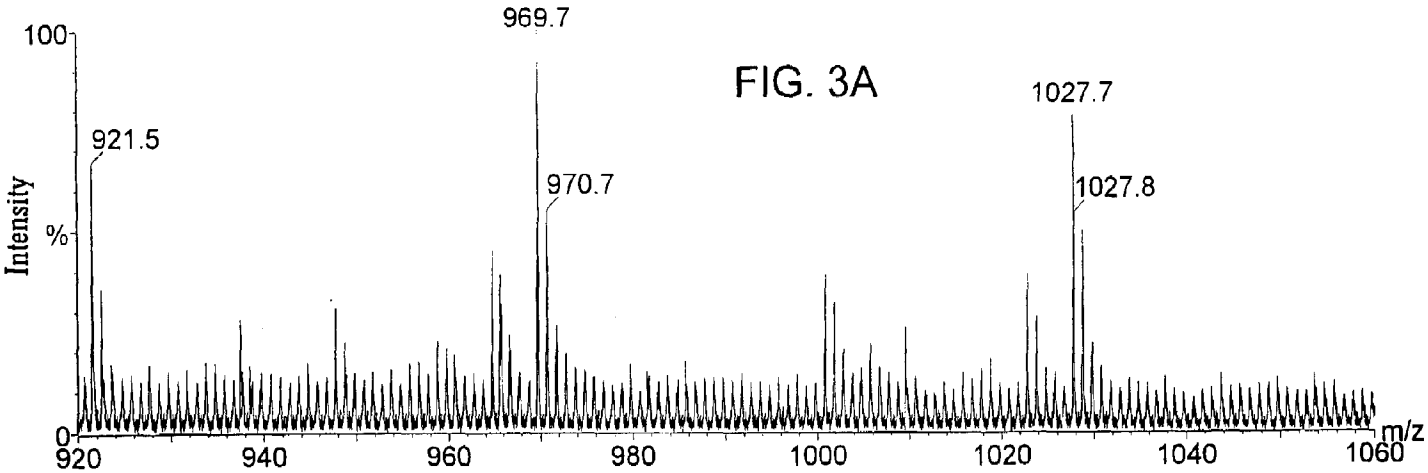
FIG. 3A shows a portion of a mass spectrum exhibiting periodic background noise and FIG. 3B shows the same portion of the mass spectrum after removal of the periodic background noise according to the preferred embodiment.
Figure 3B:
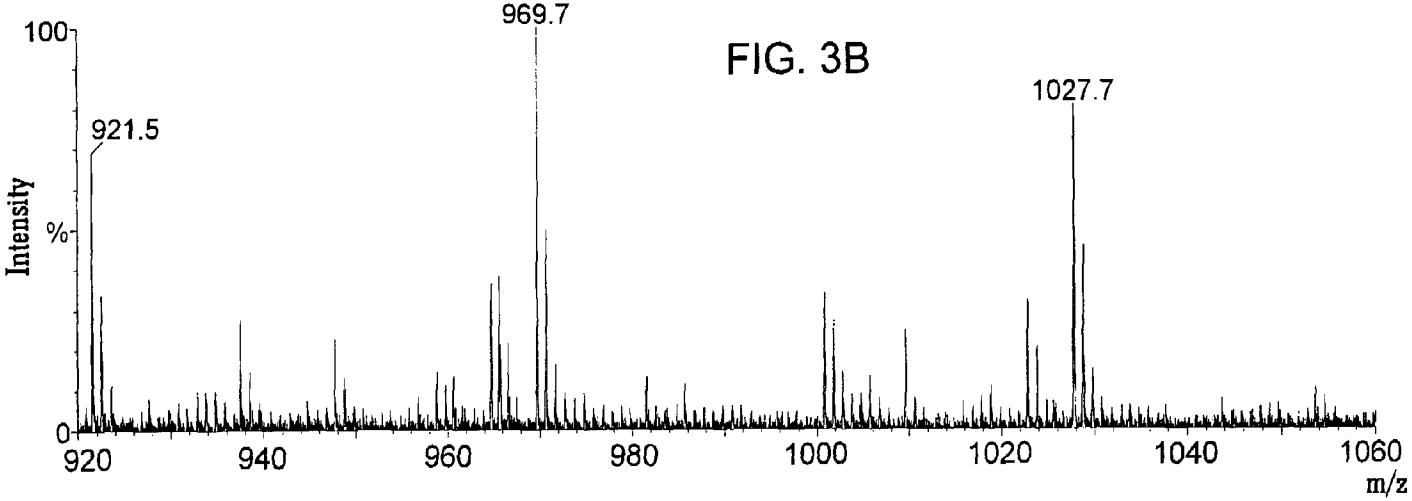

FIG. 3A shows a portion of a mass spectrum exhibiting periodic background noise having a periodicity of approximately 1 atomic mass unit. The mass spectrum was obtained using an Electrospray ion source and a Time of Flight mass analyser. Although intense analyte peaks can be identified, it is difficult to discern comparatively weaker analyte peaks from amongst the periodic background noise. FIG. 3B shows the same portion of the mass spectrum after the periodic background noise has been estimated and subtracted from the intensity data according to the preferred embodiment. In this particular example the overall mass window applied to the mass spectral data comprised 21 nominal mass windows each having a width of 1.0005 atomic mass units (Daltons). Each nominal mass window was divided into 20 channels and a 45% intensity quantile was used to discriminate between signal and background noise.

Figure 4A:
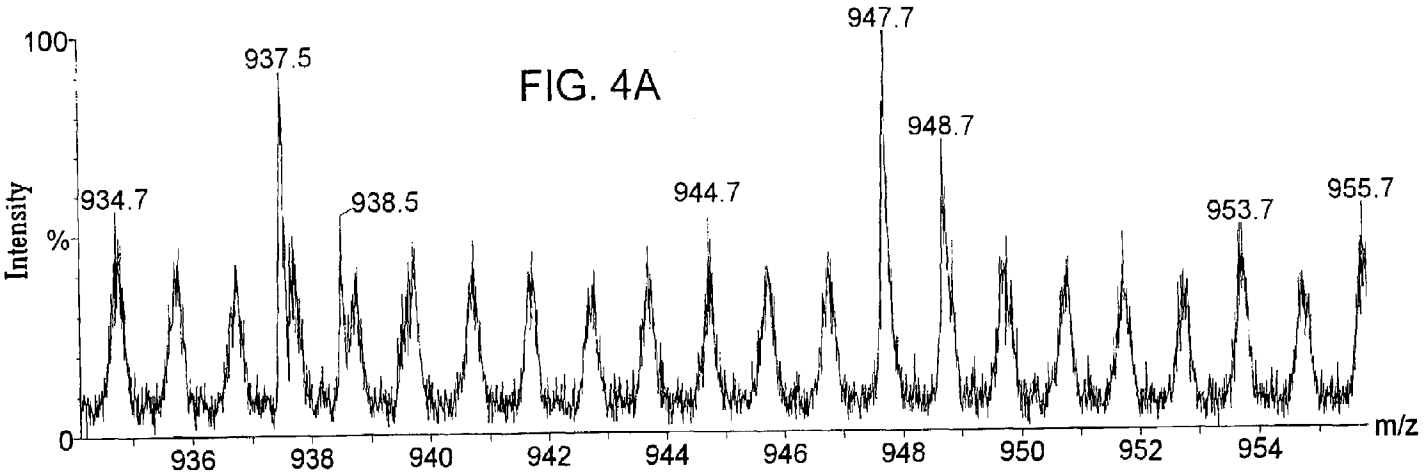
FIG. 4A shows in greater detail a portion of the mass spectrum shown in FIG. 3A.
Figure 4B:
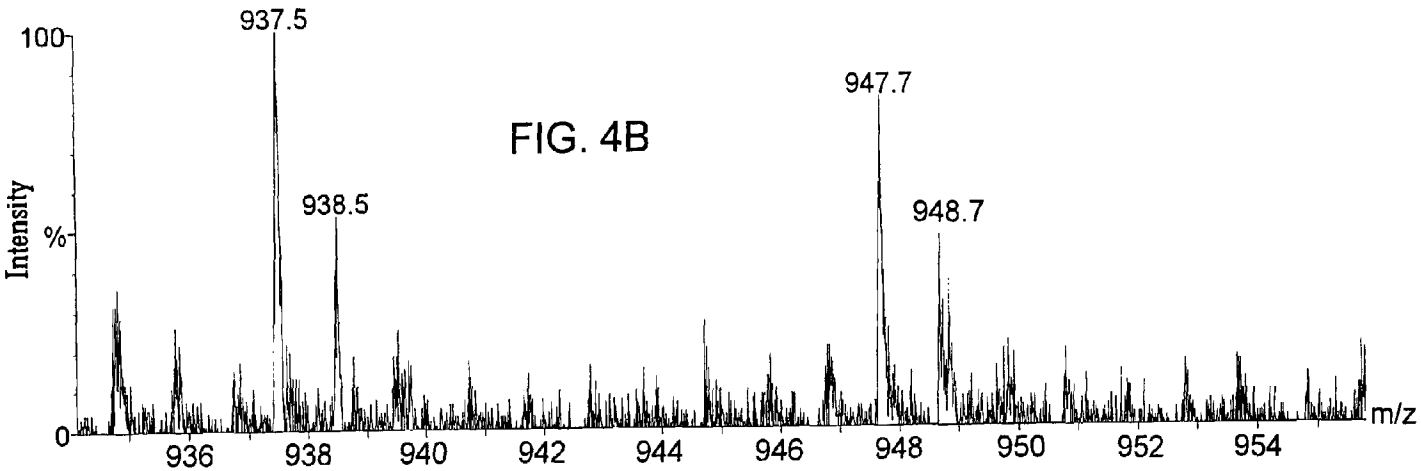
FIG. 4B shows the same portion of the mass spectrum after removal of the periodic background noise according to the preferred embodiment and FIG. 4C shows the estimated periodic background noise which was subtracted from the unprocessed mass spectrum shown in FIG. 4A.
Figure 4C:
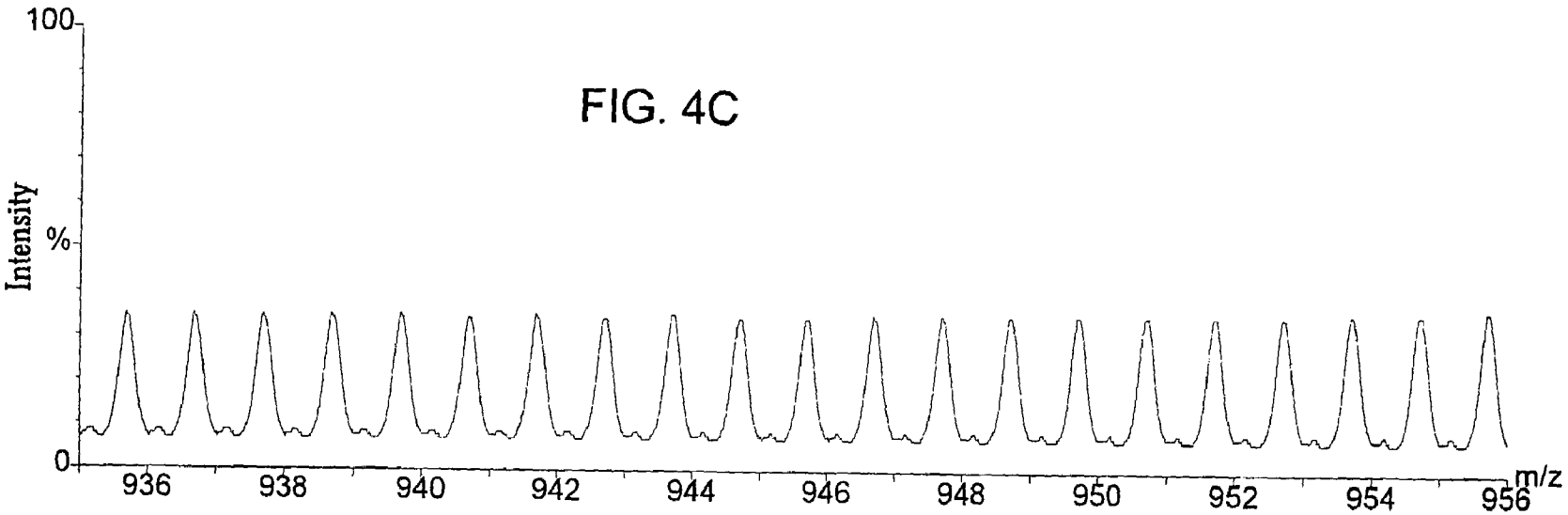

FIG. 4A shows in greater detail a portion of the mass spectrum shown in FIG. 3A over the mass to charge ratio range 934-956. As can be seen, the intensity of some of the analyte mass peaks are not significantly greater than the intensity of some of the peaks due to periodic background noise. It is to be noted, for example, that peak recognition software has suggested that peaks observed having mass to charge ratios of 944.7, 953.7 and 955.7 are analyte peaks. However, in fact, these peaks are believed to be peaks due to background noise. FIG. 4B shows a corresponding mass spectrum after the periodic background noise has been estimated and subtracted from the intensity data shown in FIG. 4A. Analyte peaks having mass to charge ratios of 937.5, 938.5, 947.7 and 948.7 are now more clearly identifiable as being analyte peaks. Furthermore, the peaks observed in FIG. 4A which were determined as having mass to charge ratios of 944.7, 953.7 and 955.7 have now been substantially suppressed as background noise. FIG. 4C shows the intensity of the periodic background noise as calculated or estimated according to the preferred embodiment for the intensity data shown in FIG. 4A. The background noise shown in FIG. 4C was removed or otherwise subtracted from the raw mass spectral data shown in FIG. 4A to produce the improved processed mass spectrum shown in FIG. 4B.

Figure 5A:
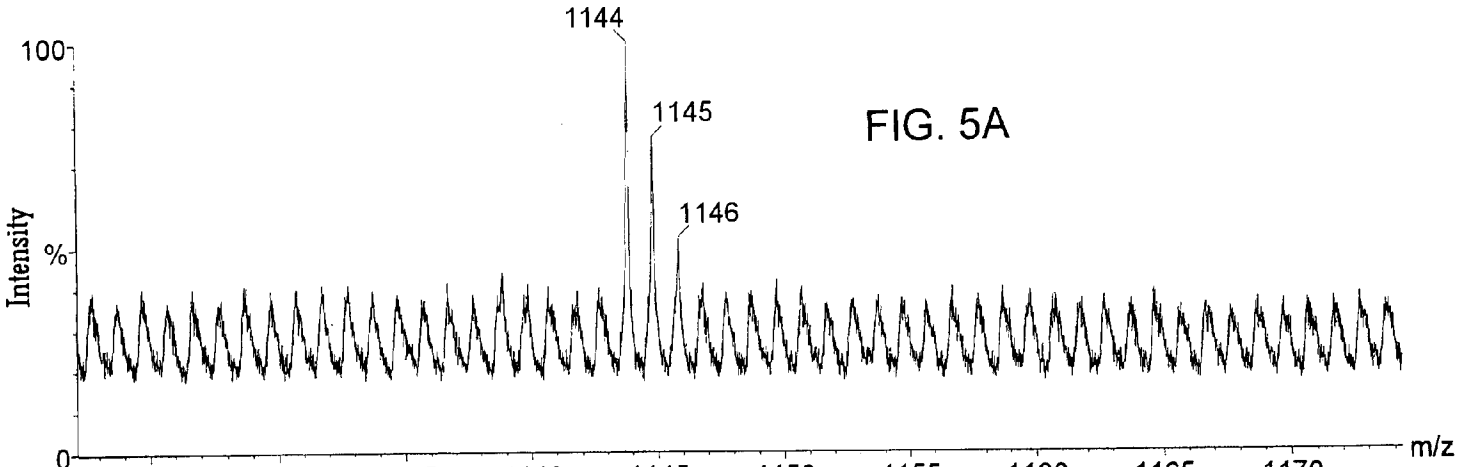
FIG. 5A shows a portion of a mass spectrum exhibiting periodic background noise and FIG. 5B shows the same portion of the mass spectrum after removal of the periodic background noise according to the preferred embodiment.
Figure 5B:
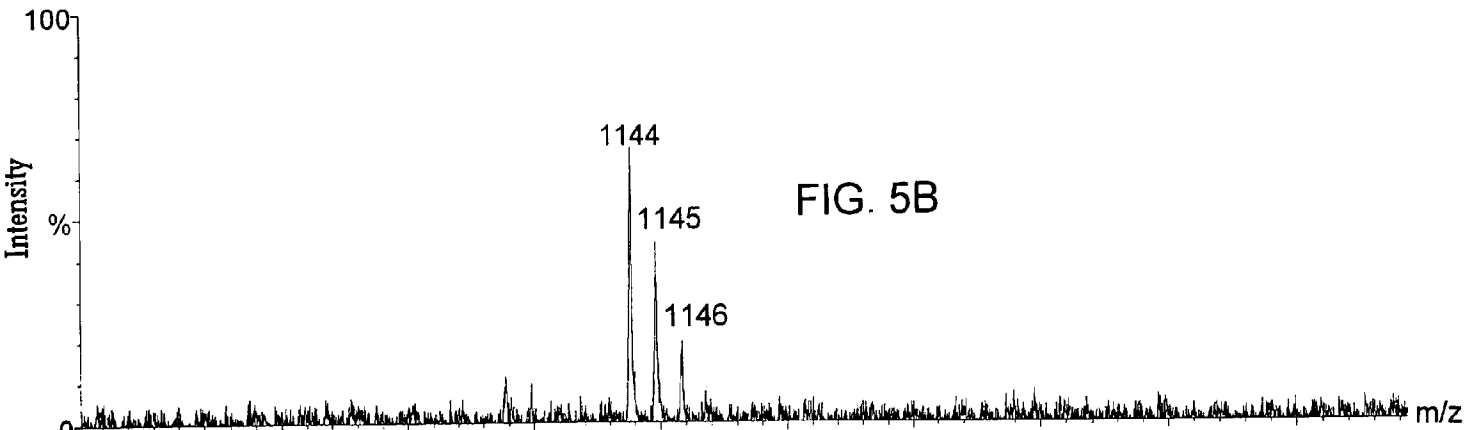

FIG. 5A shows another portion of a mass spectrum exhibiting periodic background noise having a periodicity of approximately 1 atomic mass unit. The mass spectrum was obtained using an Electrospray ion source and a Time of Flight mass analyser. FIG. 5B shows the resultant mass spectrum after the periodic background noise had been calculated or estimated and subtracted from the intensity data according to the preferred embodiment. An overall mass window comprising 21 nominal mass windows each 1.0005 atomic mass units (Daltons) wide was applied to the mass spectral data. Each nominal mass window was divided into 20 channels and a 45% intensity quantile was used to discriminate between signal and background. As can been seen from FIG. 5B, the periodic background noise has been strongly suppressed and the signal to noise ratio has been significantly enhanced or improved.

Figure 6A:
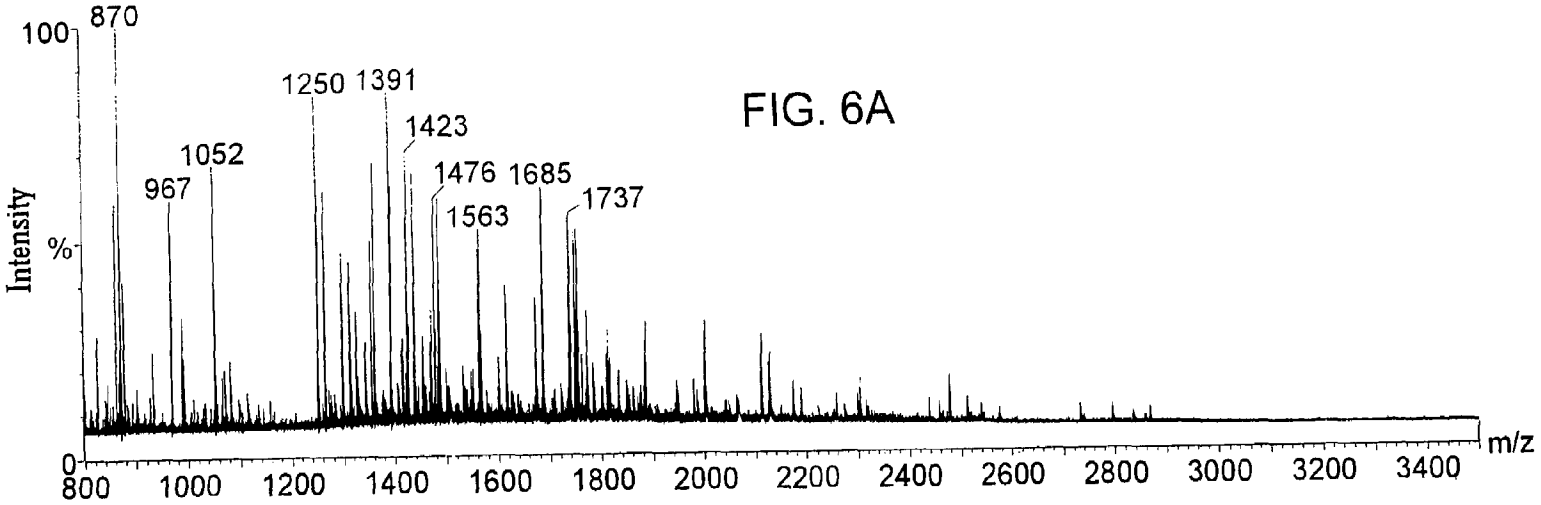
FIG. 6A shows a portion of a mass spectrum exhibiting slowly continuous and periodic background noise and FIG. 6B shows the same portion of the mass spectrum after removal of the slowly continuous and periodic background noise according to the preferred embodiment.
Figure 6B:
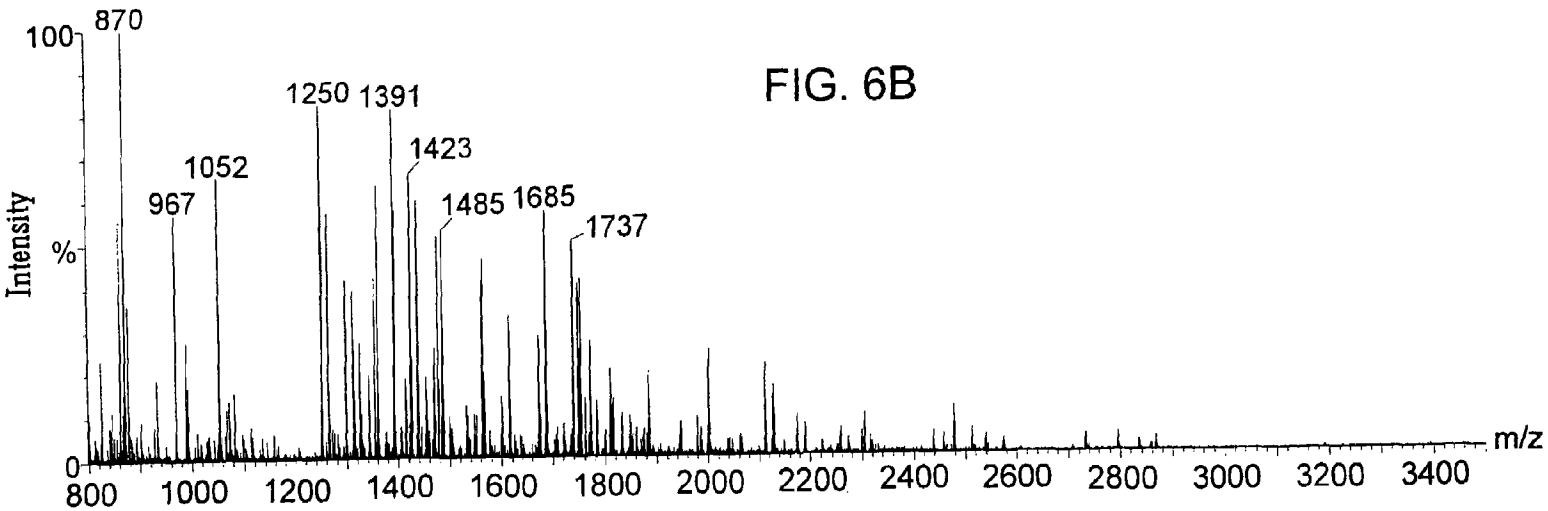

FIG. 6A shows a mass spectrum of the tryptic digest products of a protein ionised by a Matrix Assisted Laser Desorption Ionisation ion source and mass analysed by an axial Time of Flight mass analyser. The mass spectrum exhibits both slowly varying background noise and also periodic background noise (as can be seen more clearly in FIG. 7A). FIG. 6B shows the resultant mass spectrum after the slowly varying background noise and also the periodic background noise had been calculated or estimated and subtracted from the intensity data according to the preferred embodiment. An overall mass window comprising 21 nominal mass windows each 1.0005 atomic mass units (Daltons) wide was applied to the mass spectral data. Each nominal mass window was divided into 20 channels and a 45% intensity quantile was used to discriminate between signal and background.

Figure 7A:
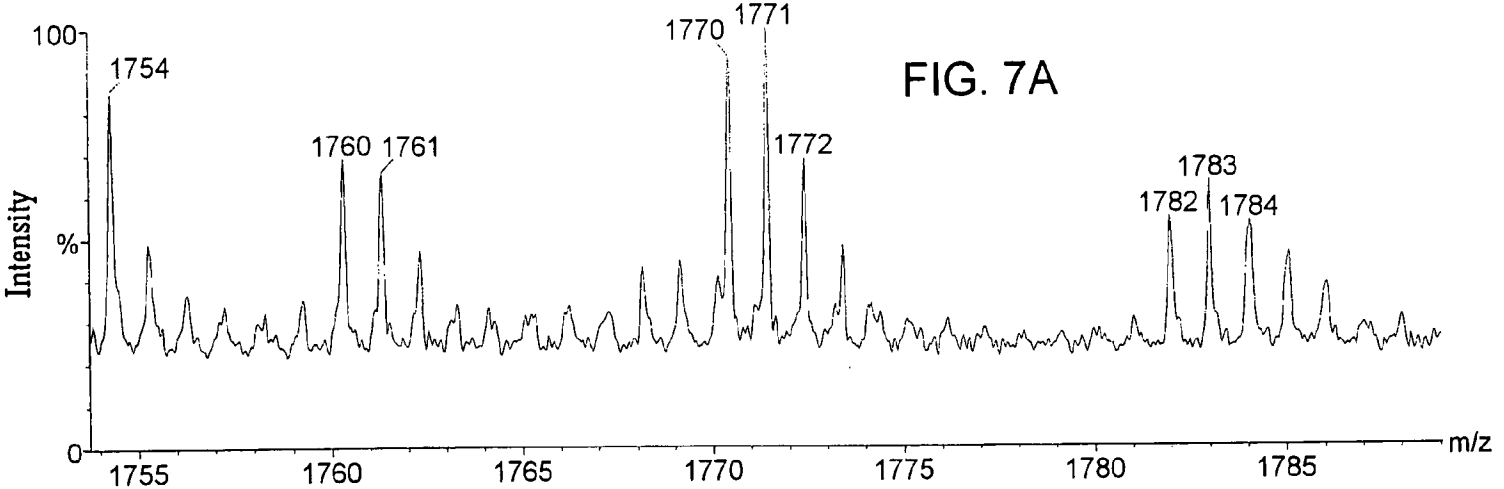
FIG. 7A shows in greater detail a portion of the mass spectrum shown in FIG. 6A.
Figure 7B:
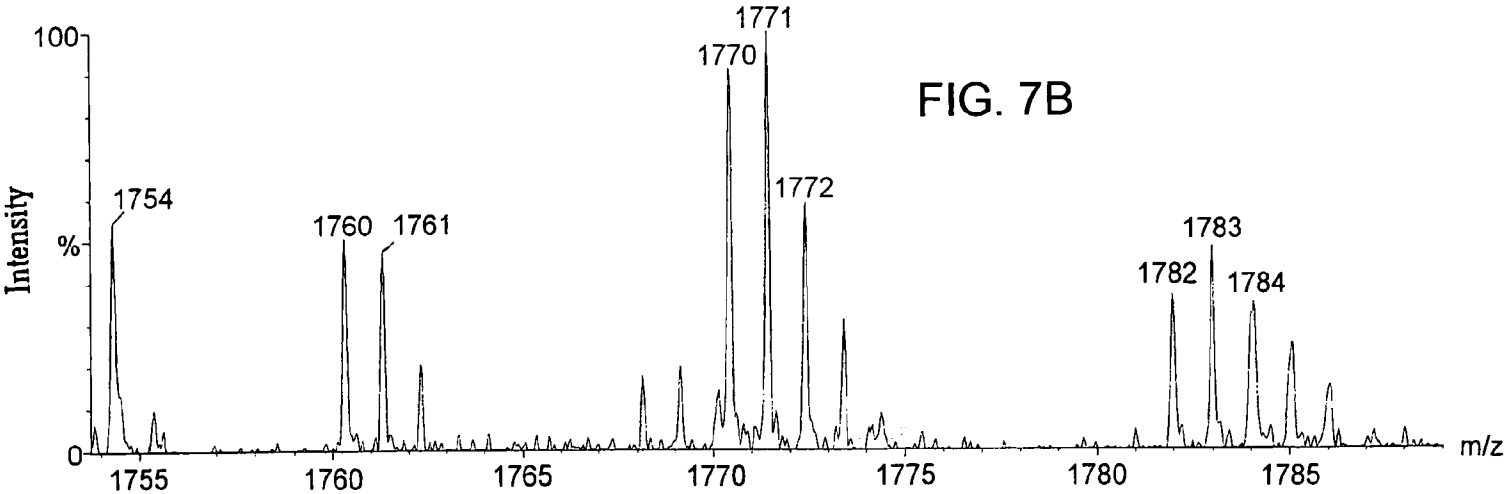
FIG. 7B shows the same portion of the mass spectrum after removal of the slowly continuous and periodic background noise according to the preferred embodiment.

FIG. 7A shows in greater detail a portion of the mass spectrum shown in FIG. 6A over the mass to charge ratio range 1754-1789. FIG. 7B shows the resultant mass spectrum after the slowly varying background noise and the periodic background noise had been estimated and subtracted from the intensity data according to the preferred embodiment. As can be seen from FIG. 7B, the background noise has been strongly suppressed and the signal to noise ratio has been significantly improved.

The preferred embodiment is particularly effective in reducing the undesired effects of chemical background noise having a periodicity of approximately 1 atomic mass unit as is commonly observed in mass spectra at mass to charge ratios less than 2000. Other embodiments are also contemplated wherein different width nominal mass windows and/or a different number of channels per nominal mass window may be used particularly when the background noise in a mass spectrum exhibits a periodicity other than approximately 1 atomic mass unit and/or when the background noise exhibits a more complex nature.

Embodiments are also contemplated which are intended to filter out background noise which has two or more characteristic repeat periods. According to such embodiments, the format of the overall mass window applied to a mass spectrum may be modified or may vary so that the mass spectral data in, for example, only odd, even or every nth numbered nominal mass windows are sampled when determining background noise. Embodiments are also contemplated wherein each nominal mass window may have a width of, for example, 0.5 atomic mass units or some other value other than 1.

According to another embodiment in order to speed up the processing time, the intensities within one or more channels of a nominal mass window may be averaged prior to calculating the desired intensity quantile.

As mentioned above, it is possible that the intensity data after substraction of an intensity quantile could be determined as having a negative value. In such circumstances the intensity data is then preferably set or adjusted to zero or to near zero.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry comprising: applying an overall mass window, comprising m nominal mass windows, to a mass spectrum, wherein m is greater than 2; dividing some or all of said nominal mass windows into y channels, where y is greater than 1; determining the frequency of the various intensities of said mass spectrum in one or more of the nth channels of said nominal mass windows to provide an intensity distribution; estimating a background intensity for one or more of said nth channels from said intensity distribution; and adjusting the intensity of one or more of said nth channels in order to remove or reduce the effects of said estimated background intensity; wherein said step of estimating a background intensity for one or more of said nth channels from said intensity distribution comprises: determining an x % intensity guantile from said intensity distribution.

2. A method as claimed in claim 1, wherein said y channels are discrete non-contiguous channels.

3. A method as claimed in claim 1, wherein said y channels are substantially contiguous channels.

4. A method as claimed in claim 1, wherein said y channels have a periodicity selected from the group consisting of: (i) 0-0.1 amu; (ii) 0.1-0.2 amu; (iii) 0.2-0.3 amu; (iv) 0.3-0.4 amu; (v) 0.4-0.5 amu; (vi) 0.5-0.6 amu; (vii) 0.6-0.7 amu; (viii) 0.7-0.8 amu; (ix) 0.8-0.9 amu; (x) 0.9-1.0 amu; (xi) 1.0-1.1 amu; (xii) 1.1-1.2 amu; (xiii) 1.2-1.3 amu; (xiv) 1.3-1.4 amu; (xv) 1.4-1.5 amu; (xvi) 1.5-1.6 amu; (xvii) 1.6-1.7 amu; (xviii) 1.7-1.8 amu; (xix) 1.8-1.9 amu; (xx) 1.9-2.0 amu; and (xxi)<2.0 amu.

5. A method as claimed in claim 1, wherein y channels have a periodicity selected from the group consisting of: (i) 0.4995-0.4996 amu; (ii) 0.4996-0.4997 amu; (iii) 0.4997-0.4998 amu; (iv) 0.4998-0.4999 amu; (v) 0.4999-0.5000 amu; (vi) 0.5000-0.5001 amu; (vii) 0.5001-0.5002 amu; (viii) 0.5002-0.5003 amu; (ix) 0.5003-0.5004 amu; (x) 0.5004-0.5005 amu; (xi) 0.9990-0.9991 amu; (xii) 0.9991-0.9992 amu; (xiii) 0.9992-0.9993 amu; (xiv) 0.9993-0.9994 amu; (xv) 0.9994-0.9995 amu; (xvi) 0.9995-0.9996 amu; (xvii) 0.9996-0.9997 amu; (xviii) 0.9997-0.9998 amu; (xix) 0.9998-0.9999 amu; (xx) 0.9999-1.0000 amu; (xxi) 1.0000-1.0001 amu; (xxii) 1.0001-1.0002 amu; (xxiii) 1.0002-1.0003 amu; (xxiv) 1.0003-1.0004 amu; (xxv) 1.0004-1.0005 amu; (xxvi) 1.0005-1.0006 amu; (xxvii) 1.0006-1.0007 amu; (xxviii) 1.0007-1.0008 amu; (xxix) 1.0008-1.0009 amu; (xxx) 1.0009-1.0010 amu; (xxxi) 0.5 amu; (xxxii) 1.0 amu; and (xxxiii) 1.0005 amu.

6. A method as claimed in claim 1, wherein one or more of said y channels have a width selected from the group consisting of: (i) 0-0.01 amu; (ii) 0.01 -0.02 amu; (iii) 0.02-0.03 amu; (iv) 0.03-0.04 amu; (v) 0.04-0.05 amu; (vi) 0.05-0.06 amu; (vii) 0.06-0.07 amu; (viii) 0.07-0.08 amu; (ix) 0.08-0.09 amu; (x) 0.09-0.10 amu; (xi) 0.10-0.11 amu; (xii) 0.11-0.12 amu; (xiii) 0.12-0.13 amu; (xiv) 0.13-0.14 amu; (xv) 0.14-0.15 amu; (xvi) 0.15-0.16 amu; (xvii) 0.16-0.17 amu; (xviii) 0.17-0.18 amu; (xix) 0.18-0.19 amu; (xx) 0.19-0.20 amu; and (xxi)>0.20 amu.

7. A method as claimed in claim 1, wherein m is an integer.

8. A method as claimed in claim 1, wherein m is an even number.

9. A method as claimed in claim 8, wherein m is selected from the group consisting of: (i) 4; (ii) 6; (iii) 8; (iv) 10; (v) 12; (vi) 14; (vii) 16; (viii) 18; (ix) 20; (x) 22; (xi) 24; (xii) 26; (xiii) 28; (xiv) 30; (xv) 32; (xvi) 34; (xvii) 36; (xviii) 38; (xix) 40; (xx) 42; (xxi) 44; (xxii) 46; (xxiii) 48; (xxiv) 50; and (xxv) 52.

10. A method as claimed in claim 1, wherein m is an odd number.

11. A method as claimed in claim 10, wherein m is selected from the group consisting of: (i) 3; (ii) 5; (iii) 7; (iv) 9; (v) 11; (vi) 13; (vii) 15; (viii) 17; (ix) 19; (x) 21; (xi) 23; (xii) 25; (xiii) 27; (xiv) 29; (xv) 31; (xvi) 33; (xvii) 35; (xiii) 37; (xix) 39; (xxi) 41; (xxi) 43; (xxii) 45; (xxiii) 47; (xxiv) 49; and (xxvi) ≧51.

12. A method as claimed in claim 1, wherein m is a fraction.

13. A method as claimed in claim 1, wherein said nominal mass windows comprise a substantially contiguous region or portion of said mass spectrum.

14. A method as claimed in claim 1, wherein said nominal mass windows comprise discrete or non-contiguous regions or portions of said mass spectrum.

15. A method as claimed in claim 1, wherein one or more of said nominal mass windows have a width selected from the group consisting of: (i) 0-0.1 amu; (ii) 0.1-0.2 amu; (iii) 0.2-0.3 amu; (iv) 0.3-0.4 amu; (v) 0.4-0.5 amu; (vi) 0.5-0.6 amu; (vii) 0.6-0.7 amu; (viii) 0.7-0.8 amu; (ix) 0.8-0.9 amu; (x) 0.9-1.0 amu; (xi) 1.0-1.1 amu; (xii) 1.1-1.2 amu; (xiii) 1.2-1.3 amu; (xiv) 1.3-1.4 amu; (xv) 1.4-1.5 amu; (xvi) 1.5-1.6 amu; (xvii) 1.6-1.7 amu; (xviii) 1.7-1.8 amu; (xix) 1.8-1.9 amu; (xx) 1.9-2.0 amu; and (xxi)>amu.

16. A method as claimed in claim 1, wherein said nominal mass windows each have a width selected from the group consisting of: (i) 0.4995-0.4996 amu; (ii) 0.4996-0.4997 amu; (iii) 0.4997-0.4998 amu; (iv) 0.4998-0.4999 amu; (v) 0.4999-0.5000 amu; (vi) 0.5000-0.5001 amu; (vii) 0.5001-0.5002 amu; (viii) 0.5002-0.5003 amu; (ix) 0.5003-0.5004 amu; (x) 0.5004-0.5005 amu; (xi) 0.9990-0.9991 amu; (xii) 0.9991-0.9992 amu; (xiii) 0.9992-0.9993 amu; (xiv) 0.9993-0.9994 amu; (xv) 0.9994-0.9995 amu; (xvi) 0.9995-0.9996 amu; (xvii) 0.9996-0.9997 amu; (xviii) 0.9997-0.9998 amu; (xix) 0.9998-0.9999 amu; (xx) 0.9999-1.0000 amu; (xxi) 1.0000-1.0001 amu; (xxii) 1.0001-1.0002 amu; (xxiii) 1.0002-1.0003 amu; (xxiv) 1.0003-1.0004 amu; (xxv) 1.0004-1.0005 amu; (xxvi) 1.0005-1.0006 amu; (xxvii) 1.0006-1.0007 amu; (xxviii) 1.0007-1.0008 amu; (xxix) 1.0008-1.0009 amu; (xxx) 1.0009-1.0010 amu; (xxxi) 0.5 amu; (xxxii) 1.0 amu; and (xxxiii) 1.0005 amu.

17. A method as claimed in claim 1, wherein y is selected from the group consisting of: (i) 2; (ii) 3; (iii) 4; (iv) 5; (v) 6; (vi) 7; (vii) 8; (vii) 9; (ix) 10; (x) 11; (xi) 12; (xi) 13; (xiii) 14; (xiv) 15; (xv) 16; (xvi) 17; (xvii) 18; (xviii) 19; (xix) 20; (xx) 21; (xxi) 22; (xxii) 23; (xxiii) 24; (xxiv) 25; (xxv) 26; (xxvi) 27; (xxvii) 28; (xxiii) 29; (xxix) 30; (xxx) 31; (xxxi) 32; (xxxii) 33; (xxxiii) 34; (xxxiv) 35; (xxxv) 36; (xxxvi) 37; (xxxvii) 38; (xxxiii) 39; (xix) 40; (xl) 41; (xli) 42; (xlii) 43; (xiii) 44; (xliv) 45; (xlv) 46; (xlvi) 47; (xlvii) 48; (xlviii) 49; (xlix) 50; and (l)>50.

18. A method as claimed in claim 1, wherein n ranges from 1 to y.

19. A method as claimed in claim 1, wherein said step of estimating a background intensity for one or more of said nth channels spectrum from said intensity distribution comprises:

determining an x % intensity quantile from said intensity distribution.

20. A method as claimed in claim 19, wherein x is selected from the group consisting of: (i) 0-5; (ii) 5-10; (iii) 10-15; (iv) 15-20; (v) 20-25; (vi) 25-30; (vii) 30-35; (viii) 35-40; (ix) 40-45; (x) 45-50; (xi) 50-55; (xii 55-60; (xiii) 60-65; (xiv) 65-70; (xv) 70-75; (xvi) 75-80; (xvii) 80-85; (xix 85-90; (xx) 90-95; and (xxi) 95-100.

21. A method as claimed in claim 19, wherein said estimated background intensity comprises said x % intensity quantile or a factor thereof.

22. A method as claimed in claim 1, wherein said step of adjusting the intensity of one or more of said nth channels in order to remove or reduce the effects of said estimated background intensity comprises:

subtracting said estimated background intensity or a fraction thereof from said one or more regions or portions of said mass spectrum.

23. A method as claimed in claim 22, if the intensity of one or more of said nth channels has a negative value or values after subtraction of said estimated background intensity or a fraction thereof, then the intensity of said one or more of said nth channels is adjusted or set to zero or near zero.

24. A method as claimed in claim 22, wherein the estimated background intensity or a fraction thereof is subtracted from z % of said mass spectrum, wherein z is selected from the group consisting of: (i) 0-10; (ii) 10-20; (iii) 20-30; (iv) 30-40; (v) 40-50; (vi) 50-60; (vii) 60-70; (viii) 70-80; (ix) 80-90; and (x) 90-100.

25. A method as claimed in claim 1, wherein the estimated background intensity or a fraction thereof is subtracted from said one or more of said nth channels.

26. A method as claimed in claim 1, further comprising advancing or retreating said overall mass window one or more times.

27. A method as claimed in claim 26, wherein said overall mass window is advanced or retreated each time by a value selected from the group consisting of: (i) 0.4995-0.4996 amu; (ii) 0.4996-0.4997 amu; (iii) 0.4997-0.4998 amu; (iv) 0.4998-0.4999 amu; (v) 0.4999-0.5000 amu; (vi) 0.5000-0.5001 amu; (vii) 0.5001-0.5002 amu; (viii) 0.5002-0.5003 amu; (ix) 0.5003-0.5004 amu; (x) 0.5004-0.5005 amu; (xi) 0.9990-0.9991 amu; (xii) 0.9991-0.9992 amu; (xiii) 0.9992-0.9993 amu; (xiv) 0.9993-0.9994 amu; (xv) 0.9994-0.9995 amu; (xvi) 0.9995-0.9996 amu; (xvii) 0.9996-0.9997 amu; (xviii) 0.9997-0.9998 amu; (xix) 0.9998-0.9999 amu; (xx) 0.9999-1.0000 amu; (xxi) 1.0000-1.0001 amu; (xxii) 1.0001-1.0002 amu; (xxiii) 1.0002-1.0003 amu; (xxiv) 1.0003-1.0004 amu; (xxv) 1.0004-1.0005 amu; (xxvi) 1.0005-1.0006 amu; (xxvii) 1.0006-1.0007 amu; (xxviii) 1.0007-1.0008 amu; (xxix) 1.0008-1.0009 amu; (xxx) 1.0009-1.0010 amu; (xxxi) 0.5 amu; (xxxii) 1.0 amu; and (xxxiii) 1.0005 amu.

28. A mass spectrometer comprising: means for applying an overall mass window, comprising m nominal mass windows, to a mass spectrum, wherein m is greater than 2; means for dividing some or all of said nominal mass windows into y channels, where y is greater than 1 means for determining the frequency of the various intensities of said mass spectrum in one or more of the nth channels of said nominal mass windows to provide an intensity distribution from a plurality of regions or portions of said mass spectrum; means for estimating a background intensity for one or more of said nth channels from said intensity distribution; and means for adjusting the intensity of one or more of said nth channels in order to remove or reduce the effects of said estimated background intensity; wherein said step of estimating a background intensity for one or more of said nth channels from said intensity distribution comprises: determining an x % intensity guantile from said intensity distribution.

29. A mass spectrometer as claimed in claim 28, further comprising an ion source selected from the group consisting of: (i) an Electrospray ("ESI") ion source; (ii) an Atmospheric Pressure Chemical Ionisation ("APCI") ion source; (iii) an Atmospheric Pressure Photo Ionisation ("APPI") ion source; (iv) a Laser Desorption Ionisation ("LDI") ion source; (v) an Inductively Coupled Plasma ("ICP") ion source; (vi) an Electron Impact ("EI") ion source; (vii) a Chemical Ionisation ("CI") ion source; (viii) a Field Ionisation ("FI") ion source; (ix) a Fast Atom Bombardment ("FAB") ion source; (x) a Liquid Secondary Ion Mass Spectrometry ("LSIMS") ion source; (xi) an Atmospheric Pressure Ionisation ("API") ion source; (xii) a Field Desorption ("FD") ion source; (xiii) a Matrix Assisted Laser Desorption Ionisation ("MALDI") ion source; (xiv) a Desorption/Ionisation on Silicon ("DIGS") ion source; and (xv) a Desorption Electrospray Ionisation ("DESI") ion source.

30. A mass spectrometer as claimed in claim 28, wherein said ion source comprises a continuous ion source.

31. A mass spectrometer as claimed in claim 28, wherein said ion source comprises a pulsed ion source.

32. A mass spectrometer as claimed in claim 28, further comprising a mass analyser.

33. A mass spectrometer as claimed in claim 32, wherein said mass analyser is selected from the group consisting of: (i) an orthogonal acceleration Time of Flight mass analyser; (ii) an axial acceleration Time of Flight mass analyser; (iii) a quadrupole mass analyser; (iv) a Penning mass analyser; (v) a Fourier Transform Ion Cyclotron Resonance ("FTICR") mass analyser; (vi) a 2D or linear quadrupole ion trap; (vii) a Paul or 3D quadrupole ion trap; and (viii) a magnetic sector mass analyser.

* * * * *